United States Patent [19]

Soeffker

[11] 3,955,553

[45] May 11, 1976

[54] AUXILIARY HEATER FOR FIREPLACES

[75] Inventor: Eldred E. Soeffker, Minneapolis, Minn.

[73] Assignee: Peter Magnolo; Coon Rapids, Minn.

[22] Filed: May 23, 1974

[21] Appl. No.: 472,876

[52] U.S. Cl. ..... 126/121; 126/163 R

[51] Int. Cl.[2] ..... F24H 3/08

[58] Field of Search ..... 126/121, 135, 165, 164, 126/143, 163

[56] References Cited

UNITED STATES PATENTS

| | | | |
|---|---|---|---|
| 1,030,002 | 6/1912 | Livingston | 126/121 R X |
| 1,608,745 | 11/1926 | Holbek | 126/121 |
| 2,161,723 | 6/1939 | Rutland | 126/121 |

FOREIGN PATENTS OR APPLICATIONS

| | | | |
|---|---|---|---|
| 29,642 | 12/1896 | United Kingdom | 126/121 |
| 116,367 | 6/1918 | United Kingdom | 126/121 |
| 622,417 | 5/1949 | United Kingdom | 126/121 |
| 900,622 | 7/1962 | United Kingdom | 126/121 |

*Primary Examiner*—William F. O'Dea
*Assistant Examiner*—Harold Joyce
*Attorney, Agent, or Firm*—Williamson, Bains & Moore

[57] ABSTRACT

A heat exchanger adapted to be readily assembled and installed in an existing fireplace to recover heat which would otherwise be lost up the fireplace chimney is comprised of a plurality of upright U-shaped tubes secured together in laterally spaced relation by a rear plate removably attached across the rear, upright segments of the tubes. The heat exchanger is placed in an existing fireplace with the open front ends of the bottom and top tubular segments facing towards the front of the fireplace, and with the bottom tubular segments resting on the fireplace floor under a separate, fire grate. A manifold connected to a forced air blower may be removably connected to the forwardly facing, open front end of the bottom tubular segments of the heat exchanger to permit either forced or convection flow of air from a room through the heat exchanger tubes for heating, the heated air being expelled back into the room through the open front ends of the top tubular segments of the heat exchanger.

3 Claims, 4 Drawing Figures

AUXILIARY HEATER FOR FIREPLACES

BACKGROUND OF THE INVENTION

A wide variety of heat exchanger structures for fireplaces, providing for both forced and convection flow of air from a room, have been devised for installation in fireplaces or in conjunction with fireplaces in such a manner as to recover some of the heat which is normally lost through fireplace chimneys. Most of such previously known heat exchange structures have been built into the walls of fireplaces at the time of initial construction of the fireplace. Those heat exchanger assemblies which have been constructed for use in existing fireplaces of varying sizes have either been unduly cumbersome and expensive to install, or have been inadequate as efficient and effective heat exchangers. See, for example, U.S. Pat. Nos. 2,702,030 and 3,635,211.

The auxiliary heater of this invention has been developed with a view towards overcoming the aforesaid difficulties associated with previously known fireplace heaters, and with providing an auxiliary fireplace heater which is capable of providing the combined benefits of being quickly and easily, removably installed in an existing fireplace, and of being operable to efficiently and effectively serve as a supplemental space heater.

BRIEF SUMMARY OF THE INVENTION

The fireplace heater of this invention is particularly characterized by a compact heat exchange structure which can be shipped disassembled, and which can be quickly and easily assembled at the point of use and installed in an existing fireplace, in combination with a separate, removable fireplace grate, in such a manner as to efficiently transfer heat to air flowing through tubes of the heat exchanger by convection, or under pressure from a blower.

These basic objectives and advantages are achieved by constructing the heat exchanger in a very simple manner from a plurality of U-shaped tubes, which are removably secured together by a rear plate removably attached across the rear, upright segments of the tubes by fasteners at laterally spaced locations thereon, so as to support the tubes in upright, laterally spaced relation to each other. When assembled in this manner to provide a heat exchange structure, the heat exchanger assembly is inserted within an existing fireplace with the U-shaped tubes in an upright position, and having the open front ends of the top and bottom tubular segments positioned adjacent the front of the fireplace. The bottom tubular segments rest on the floor of the fireplace under a separate, removable grate on which burning materials and coals are supported. Thus, the bottom tubular segments are heated by radiation from the hot coals and the top tubular segments are heated by hot air rising from the fire and passing over and around the laterally spaced, top tubular segments as it flows upwardly through the chimney.

Heat transfer to the tubular segments of the U-shaped heat exchanger tubes is further enhanced by a pair of upright, laterally spaced apart baffle plates of heat conductive material which extends forwardly from the opposite ends of the heat conductive, rear plate attached to the heat exchanger tubes, and which direct heated air rising from the fireplace upwardly over and around the aforesaid, top tubular segments of the heat exchanger. As a result, the baffle plates are heated as hot air rising in the fireplace passes over them; and, the heated baffle plates conduct heat through the rear plate to the upright, rear tubular segment of the heat exchanger to assist in heating air passing through the heat exchanger tubes. Air entering the bottom tubular segments of the heat exchanger from a room is heated as it passes over the hot walls of these bottom tubular segments, and thus rises through the rear, upright segments of the heat exchanger and then flows forwardly and outwardly through the front ends of the top tubular segments of the heat exchanger, back into the room.

A particularly beneficial feature of my improved heat exchanger assembly resides in the optional use of a manifold connected to a forced air blower to provide pressurized air flow through the heat exchanger from a room. A plurality of tubular stubs project rearwardly from the manifold in laterally spaced apart relation to each other, and are snugly positioned within the open front ends of the bottom tubular segments of the heat exchanger in a sliding, removable fit therewith. Thus, the manifold and the blower may readily be connected to and removed from the bottom tubular segments of the heat exchanger as desired to provide either forced or convection flow of air through the heat exchanger tubes.

As a further beneficial aspect of my heat exchanger assembly, I provide a plurality of spaced apart orifices in the rear wall of the aforesaid forced air manifold, facing towards the heat exchanger. Thus, with the heat exchanger positioned within a fireplace in the manner described above, and with the manifold connected to the bottom tubular segments of the heat exchanger lying along the fireplace floor, pressurized air discharging through the manifold orifices will flow under the fireplace grate and upwardly through the grate, thereby fanning the fire on the grate, and inducing an upward draft in the fireplace over the fire.

These and other objects and advantages of my invention will become readily apparent as the following description is read in conjunction with the accompanying drawings wherein like reference numerals have been used to designate like elements throughout the several views.

DESCRIPTION OF THE PREFERRED EMBODIMENT

Figure 2:
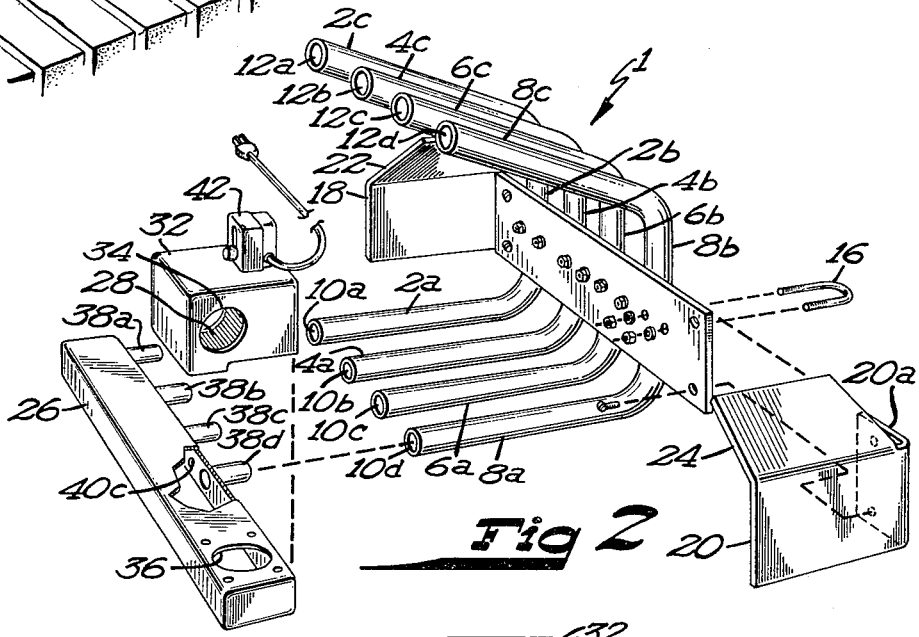
FIG. 2 is an exploded, perspective view of the auxiliary heater of this invention showing its manner of assembly.

Referring now to the drawings, I have shown in FIG. 2 the manner of assembling the auxiliary heater of this invention, the heat exchanger being generally indicated by reference numeral 1. Heat exchanger 1 is comprised of a plurality of U-shaped tubes 2, 4, 6 and 8 bent to the shape shown. Each of the air flow tubes 2, 4, 6 and 8 is positioned in an upright position, in a vertical plane, these air flow tubes being formed to include bottom tubular segments 2*a*, 4*a*, 6*a*, and 8*a*, upright, rear tubular segments 2*b*, 4*b*, 6*b* and 8*b*, and top tubular segments 2*c*, 4*c*, 6*c* and 8*c*. Bottom tubular segments 2*a*, 4*a*, 6*a* and 8*a* are open at their front ends to provide air inlet openings 10*a*, 10*b*, 10*c* and 10*d* through which air may be introduced into the heat exchanger from a room. The forwardly facing front ends of top tubular segments 2*c*, 4*c*, 6*c* and 8*c* are also open to define air discharge openings 12*a*, 12*b*, 12*c* and 12*d*.

Air flow tubes 2, 4, 6 and 8 are joined together in laterally spaced relation as shown by means of a detachable rear plate 14. Plate 14 extends horizontally across the upright, rear tubular segments 2*b*, 4*b*, 6*b* and 8*b* and is removably secured thereto in the upright position shown by means of removable fasteners, which preferably take the form of U-bolts 16. U-bolts 16 are mounted from the rear over round, upright rear tubular segments 2*b*, 4*b*, 6*b* and 8*b* and are inserted through aligned pairs of holes drilled through plate 14 at predetermined locations therein to define the laterally spaced positions of each of the air flow tubes 2, 4, 6 and 8. Plate 14 is preferably formed from heat conductive sheet metal, and is positioned in tight, abutting relation with upright, rear tubular segments 2*b*, 4*b*, 6*b* and 8*b* to assist in transferring heat thereto in a manner hereinafter explained. Extending forwardly from the opposite ends of rear plate 14 are a pair of baffle plates 18 and 20 which are detachably secured to rear plate 14 by means of right angle flanges 18*a* and 20*a*. Suitable fasteners are utilized to attach baffle plate flanges 18*a* and 20*a* to the opposite ends of rear plate 14. When so mounted, baffle plates 18 and 20 are upright and are laterally spaced apart at locations along the opposite sides of bottom tubular segments 2*a*, 4*a*, 6*a* and 8*a*. Baffle plates 18 and 20 are formed to include upwardly extending deflector panels 22 and 24 which angle inwardly towards top tubular segments 12*a*, 12*b*, 12*c* and 12*d*. Baffle plates 18, 20, and their deflector panels 22 and 24 are also preferably formed from heat conductive sheet metal.

Figure 3:
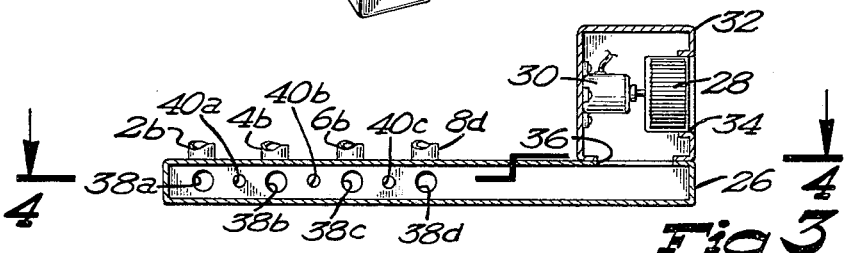
FIG. 3 is a vertical, section view of the air intake manifold and blower unit, taken along lines 3—3 of FIG. 1.

An optional forced air unit is also provided for the purpose of supplying a pressurized flow of air through the heat exchanger 1. This forced air unit is comprised of an elongated air intake manifold 26 and a blower 28 assembled in the manner most clearly shown in FIGS. 3 and 4. Blower 28 is preferably a standard, centrifugal type of blower which is driven by an electric motor 30. The blower 28 and its motor 30 are mounted within a housing 32 having an air intake opening 34 in one end thereof. Blower 28 is arranged so that it discharges downwardly into an air inlet 36 formed in the top face of one end of manifold 26. Laterally spaced along the length of rear, upright wall 26*a* of tubular manifold 26, and projecting rearwardly therefrom towards heat exchanger 1 are a plurality of tubular stubs 38*a*, 38*b*, 38*c* and 38*d*. These tubular stubs are in fluid flow communication with the interior of manifold 26, and are spaced apart the same distance as are bottom tubular segments 2*a*, 4*a*, 6*a* and 8*a* of heat exchanger 1. Tubular stubs 38*a*, 38*b*, 38*c* and 38*d* are sized so as to be insertable within the open front ends 10*a*, 10*b*, 10*c* and 10*d* of bottom tubular segments 2*a*, 4*a*, 6*a* and 8*a* of heat exchanger 1 in a snug, sliding fit therewith. Thus, manifold 26 can be very quickly and easily coupled to heat exchanger 1 by simply sliding tubular stubs 38*a*, 38*b*, 38*c* and 38*d* into the open front ends of bottom tubular segments 2*a*, 4*a*, 6*a* and 8*a*.

Figure 4:
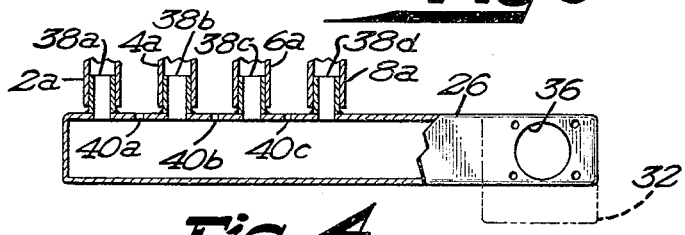
FIG. 4 is a horizontal section view of the air intake manifold and blower unit taken along lines 4—4 of FIG. 3.

Manifold 26 is also provided with a plurality of draft inducing nozzles or orifices 40*a*, 40*b* and 40*c* extending through its rear wall 26*a*, and thus facing towards heat exchanger 1 when manifold 26 is coupled thereto. Orifices 40*a*, 40*b* and 40*c* are spaced apart along the length of upright rear wall 26*a* of tubular manifold 26 as shown in FIG. 4.

If desired, a thermostat 42 may be connected to electric motor 30 of blower 28 to provide automatic control of blower 28 when forced air flow is desired.

Figure 1:
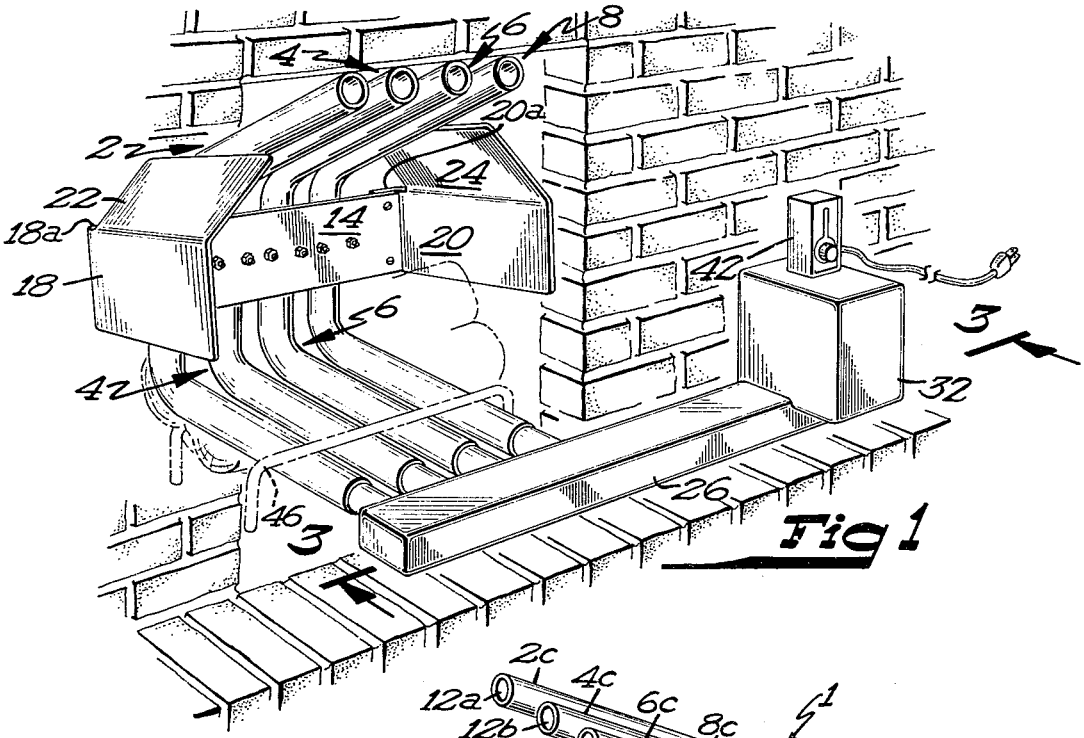
FIG. 1 is a front, perspective view showing the heat exchanger of this invention installed inside of an existing fireplace.

In FIG. 1 I have shown the preferred manner of installation of heat exchanger 1 within an existing fireplace 44. Heat exchanger 1 is adapted to be used within the fireplace in conjunction with a separate, removable fireplace grate 46. Heat exchanger 1 will preferably be shipped in disassembled, knocked-down condition, and is assembled by the user at the point of use. This is very simply accomplished, as noted above, by attached rear plate 14 to the rear, upright segments 2*b*, 4*b*, 6*b* and 8*b* of heat exchanger air flow tubes 2, 4, 6 and 8 by means of U-bolts 16. Baffle plates 18 and 20 are then attached to the opposite ends of rear plate 14 by means of their mounting flanges 18*a* and 20*a*. The thus assembled heat exchanger 1 is then positioned within a fireplace in the manner shown in FIG. 1 with air flow tubes 2, 4, 6 and 8 in upright positions, and with bottom tubular segments 2*a*, 4*a*, 6*a* and 8*a* resting on the floor of the fireplace. Heat exchanger 1 is positioned within the fireplace so that air inlet openings 10*a*, 10*b*, 10*c* and 10*d* and air discharge openings 12*a*, 12*b*, 12*c* and 12*d* face forwardly, and are substantially even with the front face of the fireplace. Fireplace grate 46, which will have previously been removed, is then positioned back in the fireplace over bottom tubular segments 2*a*, 4*a*, 6*a* and 8*a* in closely spaced relation thereto. This close spacing permits bottom tubular segments 2*a*, 4*a*, 6*a* and 8*a* to be heated by radiation from hot coals accumulating on fireplace grate 46. Since air flow tubes, 2, 4, 6 and 8 are round, any ashes which drop downwardly from grate 46 will tend to fall off of round tubular, bottom segments 2*a*, 4*a*, 6*a* and 8*a* and will not accumulate thereon. Thus, there will not be any significant accumulation of ashes on the heat exchanger tubes to interfere with heat transfer.

With heat exchanger 1 positioned within the fireplace 44 in the aforesaid manner, forwardly extending baffle plates 18 and 20 will be oriented in upright positions along opposite sides of grate 46 between the top and bottom tubular segments 2*c* – 8*c* and 2*a* – 8*a*. Baffle plates 18 and 20, and their upwardly and inwardly angling deflector panels 22 and 24 will confine and guide hot air rising upwardly in the fireplace over and around top tubular segments 2*c* – 8*c*. Thus, hot air rising from the fireplace and passing upwardly through the fireplace chimney will sweep over baffle plates 18 and 20, thereby heating these plates, and will also heat top tubular segments 2*c* – 8*c*. Heated baffle plates 18 and 20 will conduct heat to rear upright tubular segments 2*b*, 4*b*, 6*b* and 8*b* through heat conductive rear plate 14 attached thereto. Thus, in addition to the heating of bottom tubular segments 2*a* – 8*a* by hot coals on grate 46, upright, rear tubular segments 2*b* – 8*b* and top tubular segments 2*c* – 8*c* of the heat exchanger will also be heated by a combination of conduction and convection.

The aforesaid combined heat exchange effects on all of the tubular segments of heat exchange 1 will result in highly effective and efficient heating of air from the room in which fireplace 44 is located. Air entering the inlet openings 10*a*, 10*b*, 10*c* and 10*d* of heat exchanger 1 will be heated in the bottom tubular segments 2*a* – 8*a*, and will thus rise by convection in the rear tubular segments 2*b* – 8*b* and then flow forwardly and outwardly back into the room through top tubular segments 2*c* – 8*c*, and their forwardly facing discharge openings 12*a*, 12*b*, 12*c* and 12*d*.

If it is desired to obtain a more positive, force flow of air through heat exchanger 1, manifold 26 is positioned across the front end of bottom tubular segments 2*a* – 8*a* in the manner shown in FIG. 1 on the front end of the fireplace floor. Tubular stubs 38*a* – 38*d* are slidably inserted within the open front ends of bottom tubular segments 2*a* – 8*a*, and blower 28 is started either manually, or by operation of thermostat 42. This will provide a forced flow of air from the surrounding atmosphere through blower intake opening 34, manifold 26 and heat exchanger 1, back into the room. With manifold 26 coupled to bottom tubular segments 2*a* – 8*a* of the heat exchanger in the aforesaid manner, level therewith, orifices 40*a*, 40*b* and 40*c* will be facing rearwardly at a level below elevated fireplace grate 46. Thus, pressurized air discharging through orifices 40*a*, 40*b* and 40*c* will flow under grate 46 and upwardly therethrough. This will fan the fire, and induce a draft over the fire and upwardly through the chimney, thereby increasing the heat output of the fire on grate 46 and the heating of room air flowing through heat exchanger tubes 2, 4, 6 and 8.

Based on the foregoing description, it will be appreciated that I have provided a very compact auxiliary heater which can be shipped in a disassembled condition and quickly and easily assembled and installed in an existing fireplace to provide either convection or forced air flow of air through the heat exchanger for the supplemental heating of a room in which the fireplace is located. Although I have described my improved fireplace heater with respect to particular preferred embodiments thereof, I anticipate that various changes may be made in the size, shape and construction of the heating unit and its associated forced air unit without departing from the spirit and scope of my invention as defined by the following claims.

What is claimed is:

1. An auxiliary heater for use in conjunction with an existing fireplace comprising:

a heat exchanger comprised of a plurality of laterally spaced apart, generally U-shaped air flow tubes, each tube being disposed upright in a vertical plane and having a bottom, horizontally extending tubular segment with an air inlet opening at its front end, an upright, rear tubular segment, and a top, tubular segment extending forwardly from the rear tubular segment of each tube and having an air discharge opening at its front end;

an upright, rear plate of heat conductive material extending horizontally across said upright, rear tubular segments over a substantial portion of the height thereof and secured thereto in direct, heat conductive relation therewith; and a pair of upright, laterally spaced apart baffle plates of heat conductive material connected to and extending forwardly from the opposite ends of said rear plate at laterally spaced apart locations along opposite sides of said bottom tube segments and vertically positioned between said top and bottom tubular segments of said heat exchanger, each of said baffle plates including an uppermost deflector panel which angles upwardly and inwardly towards said top tubular segments to direct heated air rising from the fireplace around and between said top tubular segments, whereby, with said heat exchanger positioned within a fireplace with said rear tubular segments near the rear, upright wall of the fireplace, heated air rising in the fireplace will pass over and against said baffle plates, and the heated baffle plates will conduct heat through the rear plate to the upright, rear tubular segments to assist in heating air flowing therethrough.

2. An auxiliary heater as defined in claim 1, and further including:

an elongated manifold extending transversely across the front ends of said bottom tubular segments of said heat exchanger and having an inlet connected to the discharge side of a forced air blower, said manifold having a plurality of laterally spaced apart, tubular stubs extending rearwardly therefrom and removably, slidably positioned within said air inlet openings at the front end of said bottom tubular segments in a snug fit therewith, whereby said blower may be operated to provide forced air circulation of air from a room to be heated through said air flow tubes.

3. An auxiliary heater as defined in claim 2 wherein: said manifold is of tubular shape and has an upright rear wall to which said tubular stubs are connected in fluid flow communication therewith; and a plurality of discharge orifices through said rear wall of said manifold facing towards said heat exchanger, said orifices being spaced apart along the length of said manifold, whereby, with said heat exchanger positioned inside of a fireplace with said upright, rear tubular segments adjacent the rear, upright wall of the fireplace, said manifold will be positioned adjacent the front of the fireplace and pressurized air discharging through said orifices from the manifold will fan the fire in the fireplace and induce a draft over the fire.

* * * * *